US005443368A

United States Patent [19]

Weeks et al.

[11] Patent Number: 5,443,368

[45] Date of Patent: Aug. 22, 1995

[54] TURBOMOLECULAR PUMP WITH VALVES AND INTEGRATED ELECTRONIC CONTROLS

[75] Inventors: Alan L. Weeks, South Easton; Gerald J. Fortier, Plainville; Stephen R. Matte', Norfolk; Peter W. Gaudet, Hyde Park; Martin Stein, Bedford; Steven C. Rosner, Charlestown; Robert J. Lepofsky, Wellesley, all of Mass.

[73] Assignee: Helix Technology Corporation, Mansfield, Mass.

[21] Appl. No.: 92,692

[22] Filed: Jul. 16, 1993

[51] Int. Cl.[6] ..... F04B 49/00

[52] U.S. Cl. ..... 417/27; 417/42; 417/44.2; 417/290; 417/326; 417/423.4; 415/90; 415/118; 415/177; 415/178

[58] Field of Search ..... 417/27, 42, 44.2, 290, 417/326, 423.4; 415/90, 116, 118, 177, 178

[56] References Cited

U.S. PATENT DOCUMENTS

| | | | |
|---|---|---|---|
| 3,217,653 | 11/1965 | Griswold | 417/290 |
| 3,536,418 | 10/1970 | Breaux | 417/423.4 |
| 3,829,244 | 8/1974 | Miller | 417/53 |
| 4,918,930 | 4/1990 | Gaudet et al. | 62/55.5 |
| 4,926,648 | 5/1990 | Okumura et al. | 62/55.5 |
| 5,062,771 | 11/1991 | Satou et al. | 417/201 |

FOREIGN PATENT DOCUMENTS

| | | | |
|---|---|---|---|
| 403107599 | 5/1991 | Japan | 417/423.4 |

OTHER PUBLICATIONS

Brochure, "ATP 1500M, Magnetically Levitated Turbomolecular Pump,", Alcatel CIT Industries Division, Apr. 1992, pp. 1–4.

O'Hanlon, John F., *A User's Guide to Vacuum Technology*, Second Edition, Chapter 11, "Turbomolecular Pumps," pp. 181–195, 1989.

O'Hanlon, John F., *A User's Guide to Vacuum Technology*, Second Edition, Section 19.2, "Turbomolecular-Pumped Systems," pp. 361–368, 1989.

O'Hanlon, John F., *A User's Guide to Vacuum Technology*, Second Edition, Section 20.2.2, "Turbomolecular Pumps," pp. 393–394, 1989.

*Primary Examiner*—Richard A. Bertsch
*Assistant Examiner*—Xuan M. Thai
*Attorney, Agent, or Firm*—Hamilton, Brook, Smith & Reynolds

[57] ABSTRACT

A vacuum system comprises, as an integral assembly, a turbomolecular pump with drive motor, a vent valve, a purge valve, a roughing valve, a heater and an electronic control module. The control module has a programmed processor for controlling the motor and valves and is user programmable for establishing specific control sequences. The integral electronic control module is removable from the assembly and is connected to the other devices through a common connector assembly. Proper introduction of a purge gas through the purge valve is detected by detecting the current load on the pump drive or by detecting foreline pressure. To test the purge gas status, the purge valve may be closed and then opened as drive current or pressure is monitored. After power failure, the controller will continue normal drive of the turbomolecular pump so long as the speed of the pump has remained above a threshold value. Otherwise the vent valve will have been opened, and a start-up sequence must be initiated. During shutdown, power to the pump drive motor is discontinued and the vent valve is opened before the roughing valve is closed.

28 Claims, 6 Drawing Sheets

TURBOMOLECULAR PUMP WITH VALVES AND INTEGRATED ELECTRONIC CONTROLS

BACKGROUND

One form of vacuum pump used in high vacuum systems, such as semiconductor processing systems, is the turbomolecular pump. A turbolaolecular pump comprises a high speed turbine which drives the gas molecules. Since the turbomolecular pump operates most efficiently in the molecular flow region, the gas molecules which are driven through the pump are removed by a roughing vacuum pump which maintains a vacuum in the order of $10^{-3}$ torr at the foreline, or exhaust, of the turbomolecular pump.

Because the gas as being pumped by the turbomolecular pump may be extremely corrosive or hazardous in other ways, it is often diluted by a purge gas in the foreline region of the pump. To that end, a purge valve is coupled to the pump to introduce purge gas from an inert gas supply. The purge gas is typically introduced into the motor/bearing region.

During shutdown of the pump, gas is typically introduced about the turbine blades through a separate vent valve. The vent gas prevents back streaming of hydrocarbons from the bearing lubricants in the foreline and assists in slowing of the pump by introducing a fluid drag.

To allow the turbomolecular pump to operate more effectively, some systems use a heater blanket about the housing to warm the blades and[housing during operation and to thus evaporate any condensed gases. During continued operation, cooling water is circulated through the pump to prevent overheating of the bearings. Typical systems include a sensor for sensing bearing temperature in order to provide a warning with overheating.

A rack mounted control box is generally used to convert power from a standard electrical outlet to that required by the pump drive motor. The motor driving the turbine is typically a DC brushless motor driven through a speed control feedback loop or an AC synchronous motor. More sophisticated controllers may be connected to the various valves of the system to open and close those valves according to some user programmable sequence. Leads from the controller are coupled to the pump drive motor, the temperature sensor and each valve to be actuated.

SUMMARY OF THE INVENTION

The present invention is directed to a vacuum system comprising a turbomolecular pump and its associated vent, purge and roughing valves and blanket heater in an integral package with user programmable electronics. The invention also relates to specific control sequences for the system.

A preferred vacuum system embodying the present invention comprises a motor driven turbomolecular pump and a roughing valve for opening a foreline of the turbomolecular pump to a roughing pump. A vent valve introduces gas into the turbomolecular pump for slowing the pump during shutdown, and a purge valve introduces purge gas into the turbomolecular pump to dilute gas being pumped. An electronic control module has a programmed processor for controlling the turbomolecular pump drive motor, heater, vent valve, purge valve and roughing valve. The processor is user programmable for establishing specific control sequences.

The module is removable from the integral assembly and is connected to the drive motor, heater and valves through a common connector assembly.

The preferred system further comprises a sensor for sensing that purge gas is being introduced into the turbomolecular pump. The senor may sense load on the turbomolecular pump by sensing current through the pump motor or it may sense foreline pressure. During operation, the purge gas may be tested by sensing system response as the purge valve is closed and opened.

The system may comprise a heater for heating the turbomolecular pump and a sensor for sensing temperature of the turbomolecular pump. The electronic control module responds to the temperature sensor and drives the heater to control the temperature of the turbomolecular pump.

The electronic control module may control shutdown of the vacuum system by turning off power to the drive motor and opening the vent valve. Only subsequently is the roughing valve closed. By thus closing the roughing valve only after the vent valve has been opened, there can be no back streaming of gases through the turbomolecular pump as the pump slows down. By introducing the vent gas into a midsection of the rotor, potential damage to the bearings with the prompt pressure change is avoided. A delay of a few seconds between opening of the vent valve and closing of the roughing valve is preferred.

After a power failure, the system will typically open the vent valve to prevent back streaming once the rotor speed has dropped below a threshold value. With return of power, the electronic control only continues normal drive to the turbomolecular pump drive motor if the rotor remains above that threshold speed. Otherwise a start-up procedure must be initiated.

The system may further include a pressure sensor, and the electronic control may control the speed of the drive motor to the driven molecular pump in response to the sensed pressure. The sensed pressure may be the total pressure sensed by a thermocouple pressure gauge or an ionization gauge, or in some cases it may more advantageously be a partial pressure as can be obtained through a residual gas analyzer.

An accelerometer may be included to provide vibrational information.

Individual and local electronic control of each turbomolecular pump has many advantages over strictly central and remote control. Although the present system has the advantage of being open to control and monitoring from a remote central station, control of any pump is not dependent on that central station. Therefore, but for a power outage, it is much less likely that all pumps in a system will be down simultaneously. Local storage of data such as calibration data and data histories are readily retained in the local memory without requiring any access to the central station. Thus, for example, in servicing a pump by replacing a module, the service person need not input any new data into the central computer because all necessary information is retained and set at the pump itself. Also, in servicing a pump, it is much more convenient to the service person to have full control of the pump when he is at the pump itself rather than having to seek control through a remote computer. The local full control of the turbomolecular pump facilitates enhancements to individual pumps because there is no burden on the central computer. As a result, any procedural improvements which provide faster, more thorough operation are more likely to be implemented. The removable module greatly facilitates servicing of the unit, and a battery-backed memory allows such servicing without loss of data. The module also facilitates upgrading of any individual pump.

BRIEF DESCRIPTION OF THE DRAWINGS

The foregoing and other ,objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
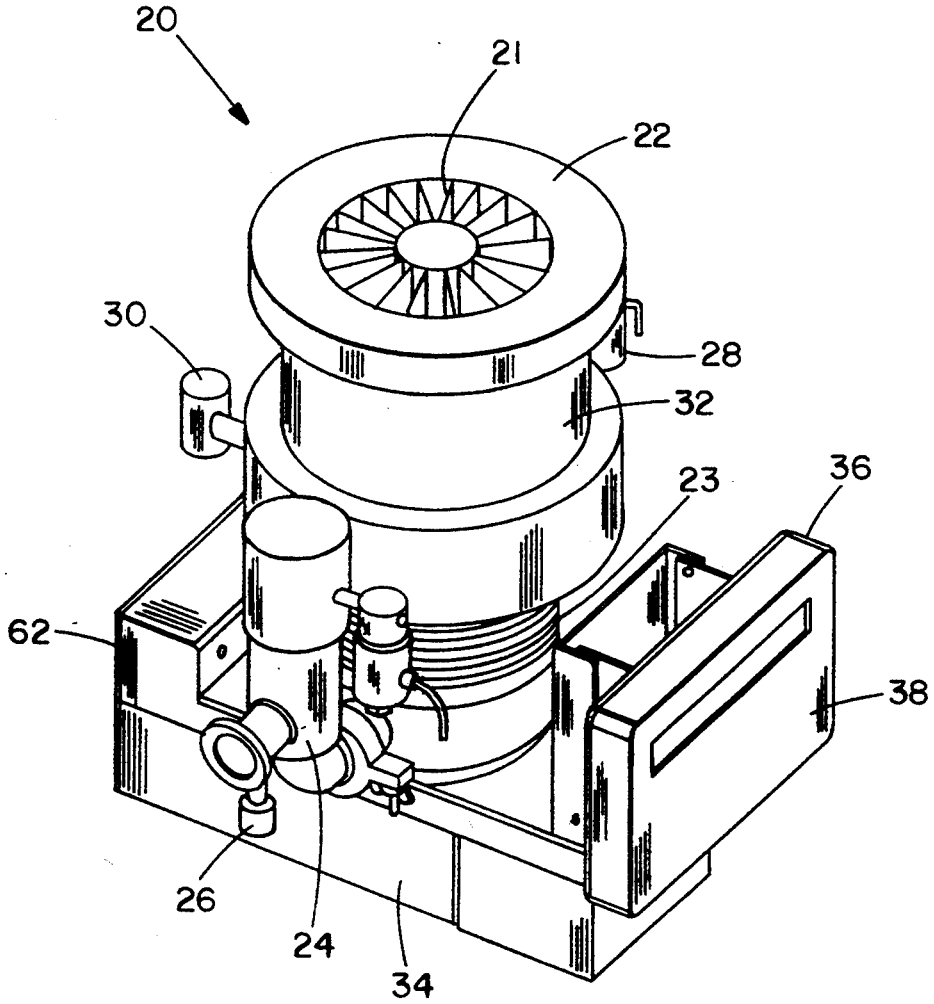
FIG. 1 is a perspective view of a turbomolecular pump with integral valves and electronics module embodying the present invention.

FIG. 1 is an illustration of a turbomolecular pump system embodying the present invention. The system includes a conventional turbomolecular pump 26 with turbine blades 21 and a drive motor mounted in a finned chamber 23. The pump may be coupled to a system to be evacuated by means of a flange 22. Gas molecules pumped by the turbopump into a foreline chamber at the lower end of the housing 20 is evacuated to a roughing pump through a roughing valve 24. A thermocouple pressure gauge 26 is coupled to the valve outlet.

A vent valve 28 is provided to introduce gas, preferably an inert gas such as nitrogen, into the turbomolecular pump during shutdown of the system. The vented gas prevents back streaming of hydrocarbons from the pump bearings to the process chamber and also serves to more quickly bring the turbine blades to a stop. Preferably, the vent gas is introduced into a midsection of the turbine in order to balance forces on the turbine with the quick change in pressure, thus minimizing wear on the bearings.

A purge valve 30 is also coupled to an inert gas source. The purge gas is typically introduced into the motor and bearing region of the pump to prevent the motor and bearings from being affected by any corrosive gases pumped through the system and also serves to dilute any hazardous gases which are pumped through the roughing valve 24 to the roughing pump.

Also included in the system is a heating jacket 32 for heating the turbine blades and housing and thus evaporating any condensed gases.

In accordance with the present invention, the turbomolecular pump system further includes an electronics controller 34 integrally packaged with the pump and the above-described valves and heater. The electronic controller responds to an internal program, which may be user modifiable, and to various sensors to control start-up, normal operation and shutdown of the system by controlling the drive motor, the heater 32 and the valves 24, 28 and 30. The sensors may include the thermocouple sensor 26, a typical bearing temperature sensor, a sensor for sensing the temperature to which the housing is heated by heater 32, a rotational speed sensor and current sensors associated with the drive motor.

Figure 2:
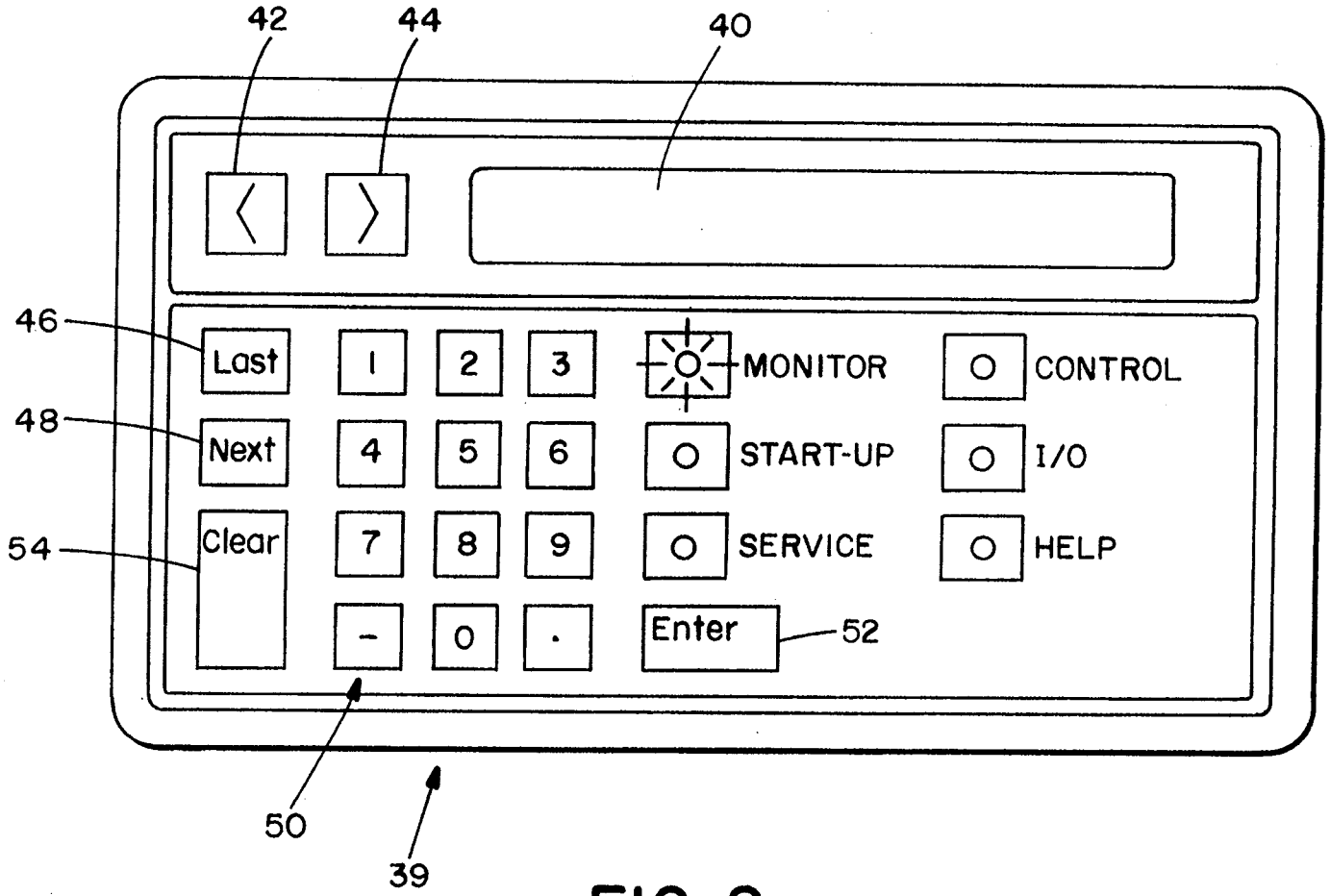
FIG. 2 is an illustration of the control panel of the assembly of FIG. 1.

The control pad 36 has a hinged cover plate 38 which, when opened, exposes a user terminal 39 with keyboard and display illustrated in FIG. 2. The control pad provides the means for programming, controlling and monitoring all turbomolecular pump functions, It includes an alphanumeric display 40 which displays up to sixteen characters. Longer messages can be accessed by the horizontal scroll display keys 42 and 44. Additional lines of messages and menu items may be displayed by the vertical scroll display keys 46 and 48. Numerical data may be input to the system by keys 50. The ENTER and CLEAR keys 52 and 54 are used to enter and clear data during programming. A MONITOR function key allows the display of sensor data. A CONTROL function key allows the operator to control various on and off functions. The I/O function key allows the operator to program the opening and closing of two set point relays. The START-UP function key allows automatic start-up and shutdown sequences to be programmed. The SERVICE function key causes service-type data to be displayed and allows the setting of a password and password lockout of other functions. The HELP function key provides additional information when used in conjunction with the other five keys.

Access through the keyboard may be limited until a predetermined password has been input. For example, use of the keyboard and display may be limited to monitoring of system parameters, and control of the system may be prohibited without the password. Within a routine which is always protected by the password, an operator may determine whether other functions are also to be protected.

A password override may be obtained from a trusted source who has access to an override encryption algorithm. The algorithm is based on a varying parameter of the system which is available to any user. The electronic processor includes means for determining the proper override password through the same encryption algorithm. The parameter of the system may, for example, be the time of operation of the system. As a result, an operator may be allowed to override the pad, sword on select occasions without having the ability to override in the future.

Figure 3:
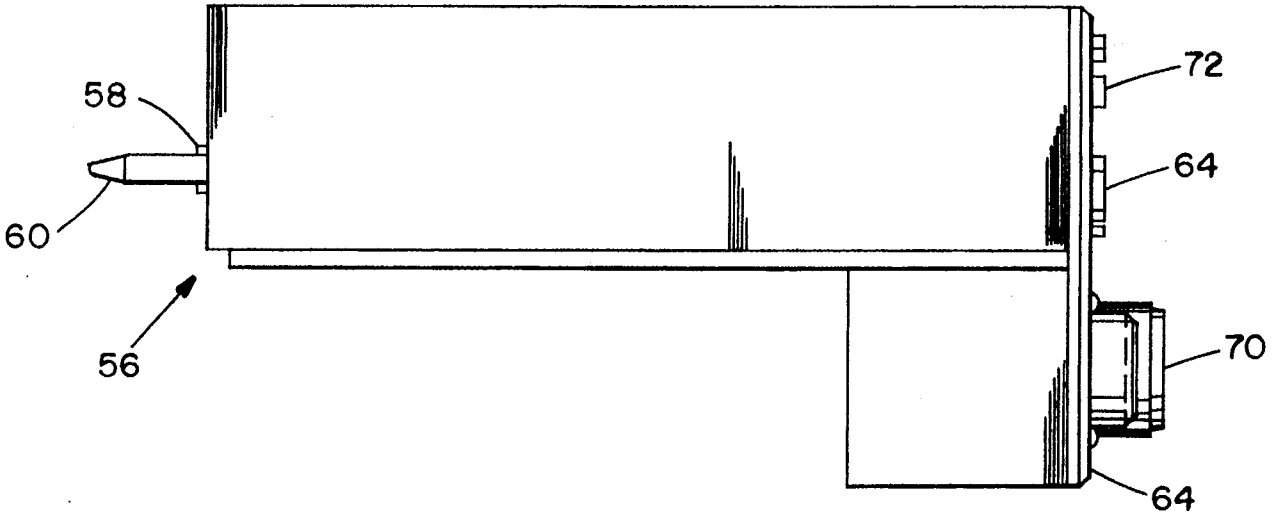
FIG. 3 is a side view of an electronic module removed from the turbomolecular pump system of FIG. 1.

In accordance with the present invention, all of the control electronics required to respond to the various sensors and control the pump drive motor, heaters and valves are housed in a module 56 illustrated in FIG. 3. A control connector 58 is positioned at one end of the module housing. It is guided by a pair of pins 60 into association with a complementary connector within the permanently mounted housing 34. All electric access to the fixed elements of the turbomolecular pump is through this connector 58. The module 56 is inserted into the housing 34 through an end opening at 62 with pins 60 leading. The opposite, external connection end 64 of the module is left exposed.

Once the module is secured within the housing 34, power lines may be coupled to connectors 70. Also included in the end of the module is a connector 6 for controlling external devices through relays in the module. Additional connectors 72 allow a remote control pad to be coupled to the system, provide incoming and outgoing communication ports for coupling the pump into a network, and provide an RS 232 port for access and control from a remote computer terminal, directly or through a modem.

Figure 4:
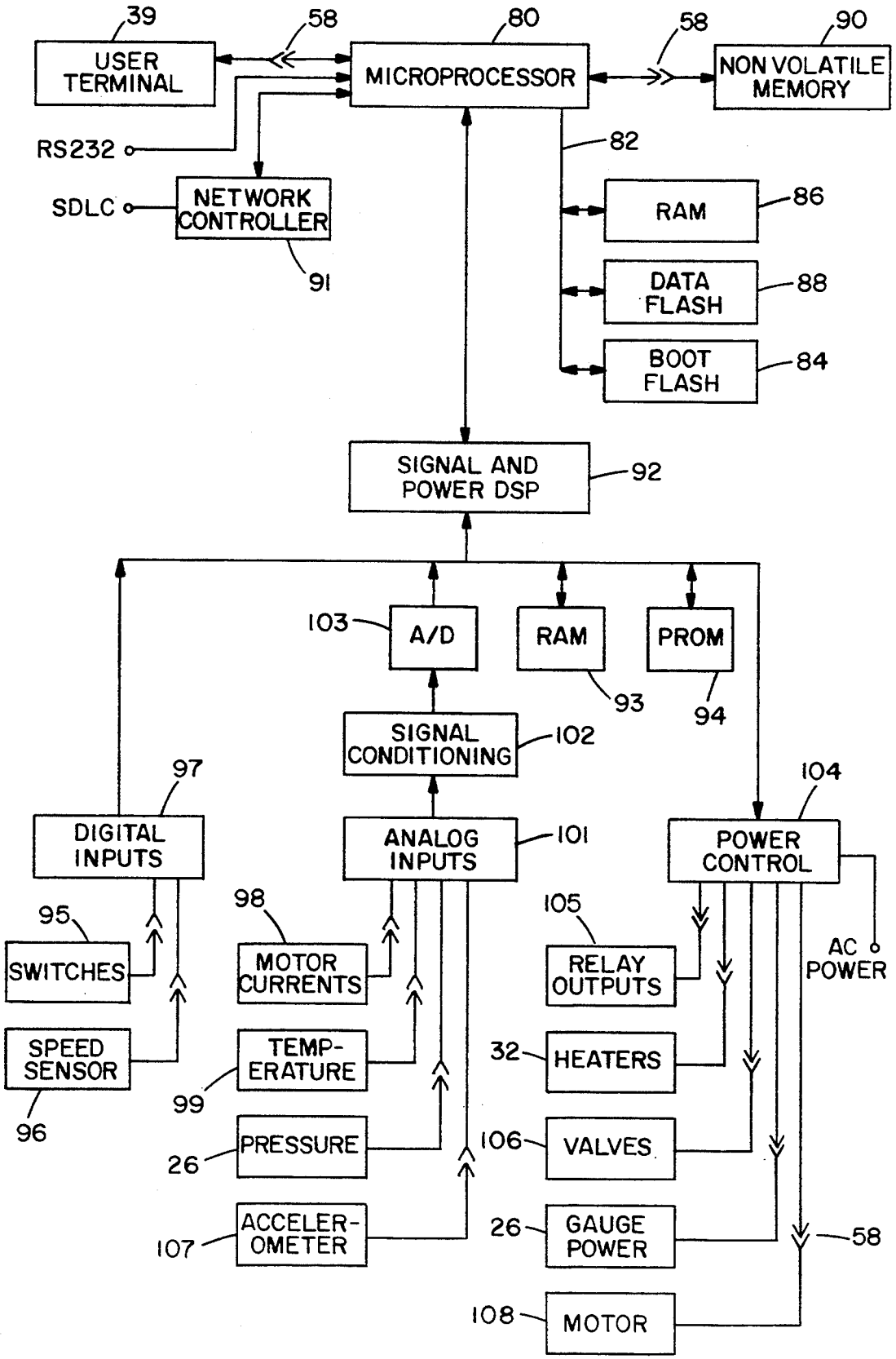
FIG. 4 is a block diagram of the controller electronics in the system of FIG. 1.

FIG. 4 provides a block diagram of the electronics module and its connections to the turbomolecular pump. A microprocessor 80 communicates with memory along a data bus 82. Memory includes a boot FLASH memory 84 which carries the system firmware and a RAM 86 which serves as a scratch pad memory and carries system serial numbers, programmable parameters, sensor characteristics, diagnostic information and use configurable information. Memory 88 is a data FLASH PROM. A FLASH memory may be erasable and writable by the microprocessor 80. Though the microprocessor generally operates through the RAM, it does copy into the data FLASH device 88 information required by the system in the event of loss of data from the RAM. That information includes calibration values and serial numbers to the system, parameters programmed into the system by a user through the keypad, and historical data including the elapsed time of operation of the pump.

An additional PROM 90 is provided. That PROM is positioned on the pump side of the connector 58 so it always remains with the turbomolecular pump even with replacement of the electronics module. To minimize the data lines through the connector, the PROM 90 preferably has serial data access. To allow storage of the user configuration and historical data, the PROM 90 is also electrically erasable and writable and is preferably a conventional EEPROM. Much of the data stored in the FLASH PROM 88 is copied into the EEPROM 90. However, to allow for use of a smaller memory device 90, only a limited amount of historical data is copied into that PROM.

With the three writable memory devices, RAM 86, FLASH memory 88 and EEPROM 90, the system has the fast operating characteristics of a RAM with the secure backup of a FLASH. Also, the data may be retained in the EEPROM 90 with movement of the module; yet the more secure and dynamic operation of the FLASH on the module is obtained.

The user terminal 39 is coupled to the microprocessor 80 through an RS 422 port. An external RS 232 port is provided for communication with a host computer. An SDLC multidrop port for serial communications networking with other pumps is also included through a network controller 91. The other pumps may include turbomolecular pumps and cryopumps as illustrated in U.S. Pat. No. 4,918,930.

Sensor inputs and drive outputs are handled by signal and power digital signal processor 92 which operates under control of the microprocessor 80. The signal processor 92 has its own RAM 93 and PROM 94. Digital sensor inputs such as those from switches 95 and a digital speed sensor 96 are received through a digital input controller 97. Analog sensor inputs such as motor current sensor 98, temperature sensor 99 and pressure sensor 26 are applied through multiplexer 101 and signal conditioner 102 to an analog-to-digital converter 103. A further novel feature of the system is an accelerometer 107 for providing history and alarm signals related to system vibration. Power is supplied through a power controller 104. The controller 104 drives relay outputs 105, the heaters 32, the valves designated generally as 106, power to the gauge 26 and power to motor 108. At each occurrence when the turbomolecular pump is started, there are a number of events which may take place, including the following:

A rough vacuum in the foreline must be established or the turbomolecular pump will not be capable of reaching normal rated speed. Direct control of a roughing pump via relay is required for some applications. Actuation of the foreline roughing valve 24 is also needed. The system is capable of sensing rough vacuum pressure in the foreline from gauge 26 for appropriate decision making.

At start-up, power is delivered to the turbomolecular pump motor and the rotor accelerates toward the speed setpoint. The minimum time to accelerate to the setpoint speed, commonly referred to a "run-up time," is determined by design. Run-up time delays are required for some applications to match pumping speed characteristics to vacuum chamber volume so that a given volume is not pumped down so quickly that gas freezes or high flow velocities result.

Heat rejection from the turbomolecular pump must be managed from start-up. Typical semiconductor applications do not use fan cooling in a clean room environment, so a water cooling system is preferred.

Pump surface temperature control is desirable for bakeout in some applications where corrosive gases can condense on the internal surfaces of a turbomolecular pump. By intermittently controlling a heater blanket 32, it is quite feasible to maintain a setpoint surface temperature for a turbomolecular pump. This feature, which is not presently found in other turbomolecular pumps offers significant advantages to many of the turbomolecular pump users in metal etch.

Purge gas flow is commonly used in corrosive pumping applications to create a positive pressure within the bearing/motor cavity and prevent migration of gases into these sensitive areas. At start-up a control valve with a properly sized orifice and filter element must be opened to initiate flow of a suitable inert gas.

Figure 5:
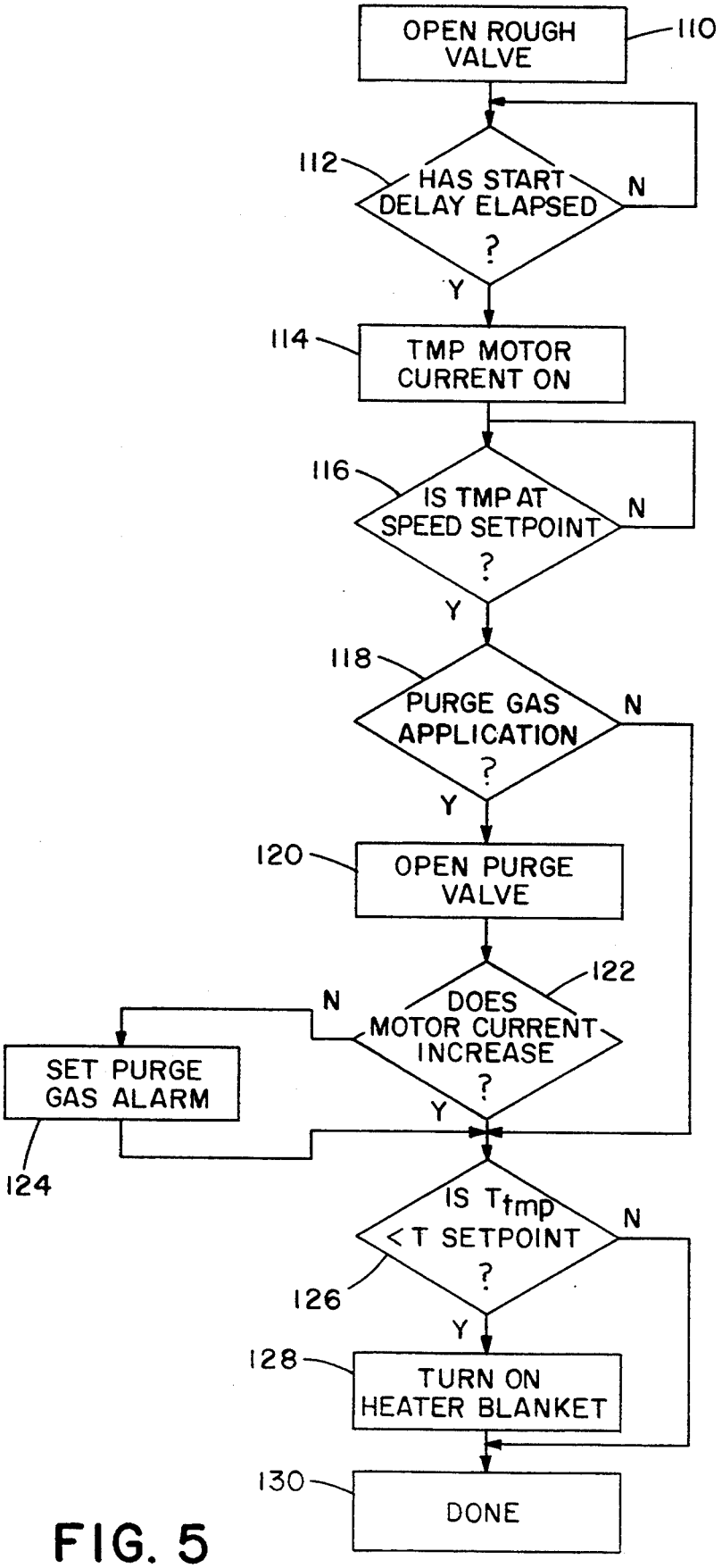
FIG. 5 is a flow chart of a preferred start-up procedure programmed into the electronics.

FIG. 5 is a flow chart of a start-up procedure.

The roughing valve 24 is turned on at 110. The system then delays at 112 until some preprogrammed start delay time has elapsed. Then, the drive motor is turned on at 114. The speed is then monitored at 116 to assure that the motor reaches a programmed setpoint.

Once the pump has reached rated speed, the purge valve may be opened. At 118 it is determined whether the user has designated this as a purge gas application. If so, the purge valve is opened at 120. A check is then made at 122 to determine whether the opening of the valve has in fact introduced purge gas. If a purge gas supply is properly connected to the valve, the motor should experience an increased load when the valve is opened, and that load will be sensed as an increase in motor current. Alternatively, an increase in pressure at the foreline pressure gauge may be sensed. If the load on the pump fails to increase sufficiently with opening of the purge valve, an alarm is set at 124.

The system checks at 126 whether the temperature of the pump housing is above or below a setpoint. If above, the heater may be left off. If below, the heater blanket 32 is turned on at 128. The start-up procedure is complete at 130.

Once the turbomolecular pump has obtained setpoint speed it may be desirable to vary speed in conjunction with a specified process variable. Variable speed operation will ultimately depend upon the type of motor/-drive used in the turbomolecular pump. DC brushless motors offer infinite speed variation, while AC induction motors are most amenable to a single low speed value (usually about 75% of rated). Pumping speed in a turbomolecular pump is directly proportional to rotating speed. Below about 50% of rated speed, most turbomolecular pumps will begin allowing the lighter gases to back diffuse from the foreline into the process chamber.

At shutdown a number of other functions must take place with termination of power to the motor as follows.

An interstage vent valve with a properly sized orifice and filter element is opened, admitting a flow of gas to quickly decelerate the turbomolecular pump rotor. Interstage venting is used to eliminate a bearing thrust load which would result from gas admission above or below the rotor stack. Users need the capability to select a suitable time delay between initiation of the shutdown sequence and opening of the want valve. Premature actuation of the vent valve due to power interruptions and accidental stop requests can be very time consuming and aggravating. The flow of vent gas also prevents back streaming of contaminants front the foreline as the turbomolecular pump coasts to a stop. When the vent valve is opened, any flow of purge gas is typically terminated by closing the purge valve.

The foreline vacuum valve must close and the roughing pump can be shut down if control has been included for the application. When the rotor is fully decelerated the vent valve is closed.

If turbomolecular pump bakeout has not been requested, coolant flow should remain on until a predetermined setpoint has been reached. If bakeout is required, the heater blanket should be controlled to bring the pump to the specified bakeout temperature.

Figure 6:
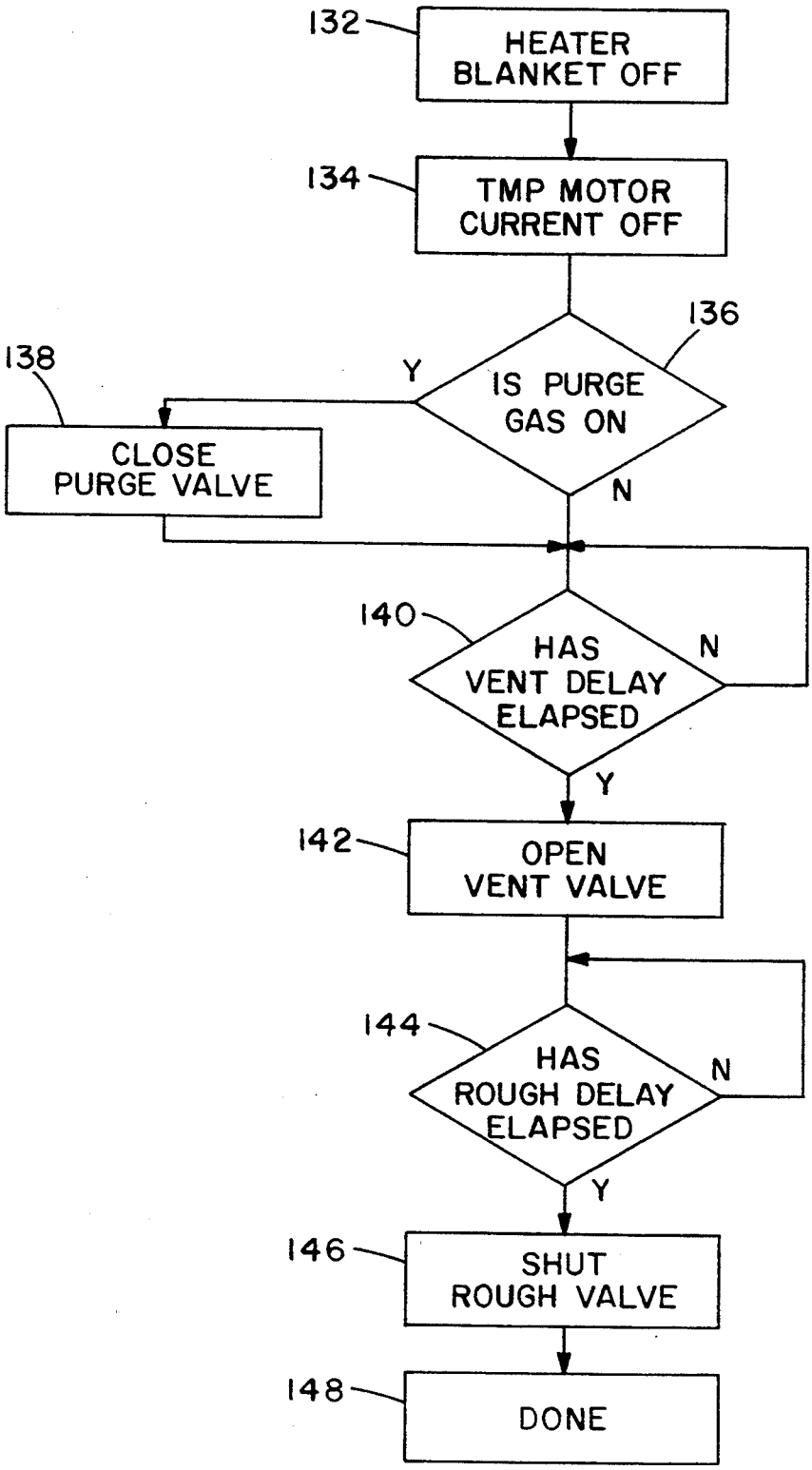
FIG. 6 is a flow chart of a preferred shutdown procedure programmed into the electronics.

A shutdown procedure is illustrated in FIG. 6A–6B. The heater blanket is turned off at 132 and the motor is turned off at 134. If the purge gas is indicated to be on at 136 the purge valve is turned off at 138. A vent delay is provided at 140 to delay opening of the vent valve 142. The delay is provided in order to allow time for recovery in the event of a power interruption or an accidental stop request.

A roughing delay is provided at 144 before the roughing valve is closed at 146. By introducing the vent gas before closing of the roughing valve, any chance of back streaming of hydrocarbon from the bearing lubricant is avoided. Once the roughing valve has been closed, the shutdown procedure is complete at 148. There are a number of diagnostic inputs which are needed for control and also to be used in a history file within memory. The following may be monitored:

1. Foreline rough vacuum pressure.
2. Valve (rough, vent, water flow and purge) position indicators.
3. Hot spot pump temperatures (motor, bearings, surface).
4. Rotational speed.
5. Run-up time.
6. Operating hours accumulated.
7. Vibration output.
8. Operational attitude.
10. Cooling water temperature.
11. Ambient air temperature.
12. Process vacuum pressure.
13. Purge gas failure.

With the information included in a history file, insight can be gained toward diagnosing turbomolecular pump health relative to the process environment. All of the above parameters may include any combination of alarm, shutdown and/or trigger messages.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A vacuum system comprising, as an integral assembly:

a turbomolecular pump with a drive motor;

a vent valve for introducing gas into the turbomolecular pump for slowing the pump; a purge valve for introducing purge gas into the turbomolecular pump;

a roughing valve for opening a foreline of the turbomolecular to a roughing pump; and an electronic control module having a programmed processor for controlling the turbomolecular pump drive motor, vent valve, purge valve, and roughing valve, the processor being user programmable for establishing specific control sequences, the electronic control module being integral with but removable from the assembly and being connected to the turbomolecular pump, drive motor, vent valve, purge valve and roughing valve through a common connector assembly.

2. A vacuum system as claimed in claim 1 wherein the purge valve is controlled by the electronic control module for introducing purge gas into the turbomolecular pump to dilute gas being pumped by the turbomolecular pump.

3. A vacuum system as claimed in claim 2 further comprising a sensor for sensing that purge gas is being introduced into the turbomolecular pump.

4. A vacuum system as claimed in claim 3 wherein the sensor determines load on the turbomolecular pump.

5. A vacuum system as claimed in claim 4 wherein the load on the turbomolecular pump is determined by sensing currents in the turbomolecular pump drive motor.

6. A vacuum system as claimed in claim 3 wherein purge gas is sensed by sensing foreline pressure.

7. A vacuum system as claimed in claim 3 wherein purge gas is sensed by sensing system response as the purge valve is closed and opened.

8. A vacuum system as claimed in claim 1 further comprising a heater for heating the turbomolecular pump and a sensor for sensing temperature of the turbomolecular pump, the electronic control module responding to the temperature sensor and driving the heater to control the temperature of the turbomolecular pump.

9. A vacuum system as claimed in claim 1 wherein the electronic control module controls shutdown of the vacuum system by turning off power to the turbomolecular pump drive motor and opening the vent valve and subsequently closing the roughing valve.

10. A vacuum system as claimed in claim 9 wherein closing of the roughing valve is delayed by a user defined time interval after opening of the vent valve.

11. A vacuum system as claimed in claim 1 wherein the electronic control module responds to return of power after a power failure by sensing speed of the turbomolecular pump and continuing normal drive of the turbomolecular pump only if the speed of the turbomolecular pump is above a threshold value.

12. A vacuum system as claimed in claim 1 further comprising a pressure sensor for sensing foreline pressure, the electronic control module controlling speed of the drive motor in response to the sensed pressure.

13. A vacuum system as claimed in claim 1 further comprising a vibrational sensor.

14. A vacuum system comprising:

a turbomolecular vacuum pump;

a purge valve for introducing purge gas into the turbomolecular pump to dilute gas being pumped by the turbomolecular pump; and a sensor for sensing that purge gas is being introduced into the turbomolecular pump.

15. A vacuum system as claimed in claim 14 wherein the sensor senses load on the turbomolecular pump.

16. A vacuum system as claimed in claim 15 wherein the load on the turbomolecular pump is determined by sensing currents in the turbomolecular pump drive motor.

17. A vacuum system as claimed in claim 14 wherein purge gas is sensed by sensing foreline pressure.

18. A vacuum system as claimed in claim 14 wherein purge gas is sensed by sensing system response as the purge valve is closed and opened.

19. A vacuum system comprising:

a turbomolecular pump; and an electronic controller for controlling the turbomolecular pump, the controller responding to return of power after a power failure by sensing speed of the turbomolecular pump and continuing normal drive of the turbomolecular pump only if the speed of the turbomolecular pump is above a threshold value.

20. A vacuum system comprising:

a turbomolecular vacuum pump; a vent valve for introducing gas into the turbomolecular pump for slowing the pump;

a purge valve for introducing purge gas into the turbomolecular pump to dilute gas being pumped by the turbomolecular pump;

a roughing valve for opening a foreline of the turbomolecular pump to a roughing pump; and an electronic controller for controlling shutdown of the vacuum system by turning off power to the turbomolecular pump and opening the vent valve, and subsequently closing the roughing valve.

21. A vacuum system comprising:

a turbomolecular vacuum pump;

a vibration sensor; and electronics integral with the turbomolecular pump for storing vibration signals from the vibration sensor.

22. A method of operating a turbomolecular vacuum pump comprising:

opening a purge valve to introduce purge gas into the turbomolecular pump to dilute gas being pumped by the turbomolecular pump; and sensing that purge gas is being introduced into the turbomolecular pump.

23. A method as claimed in claim 22 wherein the step of sensing that purge gas is being introduced is by sensing load on the turbomolecular pump.

24. A method as claimed in claim 23 wherein the load on the turbomolecular pump is sensed by sensing motor currents in the turbomolecular pump.

25. A method as claimed in claim 22 wherein purge gas is sensed by sensing foreline pressure.

26. A method as claimed in claim 22 wherein purge gas is sensed by sensing system response as the purge valve is closed and opened.

27. A method of operating a turbomolecular vacuum pump comprising:

supplying drive current to a drive motor of the turbomolecular pump; and responding to return of power after a power failure by sensing speed of the turbomolecular pump and continuing normal drive of the turbomolecular pump only if the speed of the turbomolecular pump is above a threshold value.

28. A method of shutting down a turbomolecular pump comprising:

removing power input to the turbomolecular pump drive motor and opening a vent valve; and subsequently closing a roughing valve between the turbomolecular pump and a roughing pump.

* * * * *